US006126033A

United States Patent [19]

Suttoni

[11] Patent Number: 6,126,033

[45] Date of Patent: Oct. 3, 2000

[54] PLASTIC FOOT RING DRUM

[75] Inventor: Peter G. Suttoni, Charlotte, N.C.

[73] Assignee: Hoover Materials Handling Group, Inc., Charlotte, N.C.

[21] Appl. No.: 09/234,213

[22] Filed: Jan. 20, 1999

[51] Int. Cl.[7] ..... B65D 25/24

[52] U.S. Cl. ..... 220/634; 220/604; 220/606

[58] Field of Search ..... 220/604, 605, 220/606, 633, 634, 649, 675, 659

[56] References Cited

U.S. PATENT DOCUMENTS

| | | | |
|---|---|---|---|
| 2,067,581 | 1/1937 | Smith | 220/605 |
| 4,094,432 | 6/1978 | Zilbert | 220/404 |
| 4,378,328 | 3/1983 | Przytulla et al. | 264/534 |
| 4,643,323 | 2/1987 | Schutz | 220/604 |
| 4,962,863 | 10/1990 | Wendling et al. | 220/649 |
| 5,018,642 | 5/1991 | Pyzytulla . | |
| 5,066,081 | 11/1991 | Bartley et al. | 215/373 |

*Primary Examiner*—Stephen Castellano
*Attorney, Agent, or Firm*—Wood, Phillips, VanSanten, Clark & Mortimer

[57] ABSTRACT

An open top plastic drum comprises a cylindrical side wall. A circular bottom wall is connected at a bottom end of the side wall to define an interior storage space. A foot ring is connected proximate an intersection of the side wall and the bottom wall. The foot ring comprises an annular ring having, in cross section, a generally rectangular foot for engaging a ground surface, in use, and a neck diagonally connecting the foot to the bottom end of the side wall and the bottom wall.

18 Claims, 1 Drawing Sheet

PLASTIC FOOT RING DRUM

FIELD OF THE INVENTION

This invention relates to a plastic drum having a foot ring and, more particularly, to a foot ring providing improved support for rolling the drum.

BACKGROUND OF THE INVENTION

Various container shapes and sizes are used for storage and shipment of bulk goods. Among these are drums or barrels. Originally, drums were constructed primarily of metal or of metal and fiberboard. Such drums included a cylindrical side wall crimped or otherwise connected to top and bottom walls with formed retaining rings. The retaining rings were of metal. The drum would normally be stored upright on the ground or a pallet or the like. To move the drum short distances the drum would be tilted to about a forty-five degree angle and then rolled. The metal retaining rings were configured to support such use. However, the use of metal increased cost and weight of a drum, thus increasing shipping costs. Also, metal is not readily recyclable.

More recently, plastic drums have found greater acceptance. Plastic drums are lighter in weight and of less cost to produce. Also, plastic is more readily recyclable. Plastic drums are typically of blow molded construction which results in relatively thin wall thickness. Therefore provision must be made to enable the drum to be rolled, as described above, without damaging the drum. One option is to add an annular foot ring to a bottom of the drum. The foot ring aids in rolling the drum. However, known foot ring designs are often flexible which may not provide ample support for rolling of the drum. Additionally, the foot ring helps keep the drum from sliding in a truck, on a pallet or on the floor.

The present invention is directed to solving one or more of the problems discussed above, in a novel and simple manner.

SUMMARY OF THE INVENTION

In accordance with the invention there is provided an open top plastic drum including a foot ring to provide improved support.

Broadly, there is disclosed an open top plastic drum comprising a cylindrical side wall. A circular bottom wall is connected at a bottom end of the side wall to define an interior storage space. A foot ring is connected proximate an intersection of the side wall and the bottom wall. The foot ring comprises an annular ring having, in cross section, a generally rectangular foot for engaging a ground surface, in use, and a neck diagonally connecting the foot to the bottom end of the side wall and the bottom wall.

It is a feature of the invention that the neck is connected to a top of the foot. The neck narrows diagonally upwardly from the foot and the widens to connect to the bottom wall and the side wall.

It is another feature of the invention that the foot is generally square in cross section.

It is yet another feature of the invention that the bottom wall is generally planar and is at an elevation above a bottom surface of the foot. The bottom wall has a downwardly opening annular channel radially inwardly of the neck.

It is yet a further feature of the invention that the side wall has a radially outwardly opening groove upwardly of the neck.

DETAILED DESCRIPTION OF THE INVENTION

Figure 1:
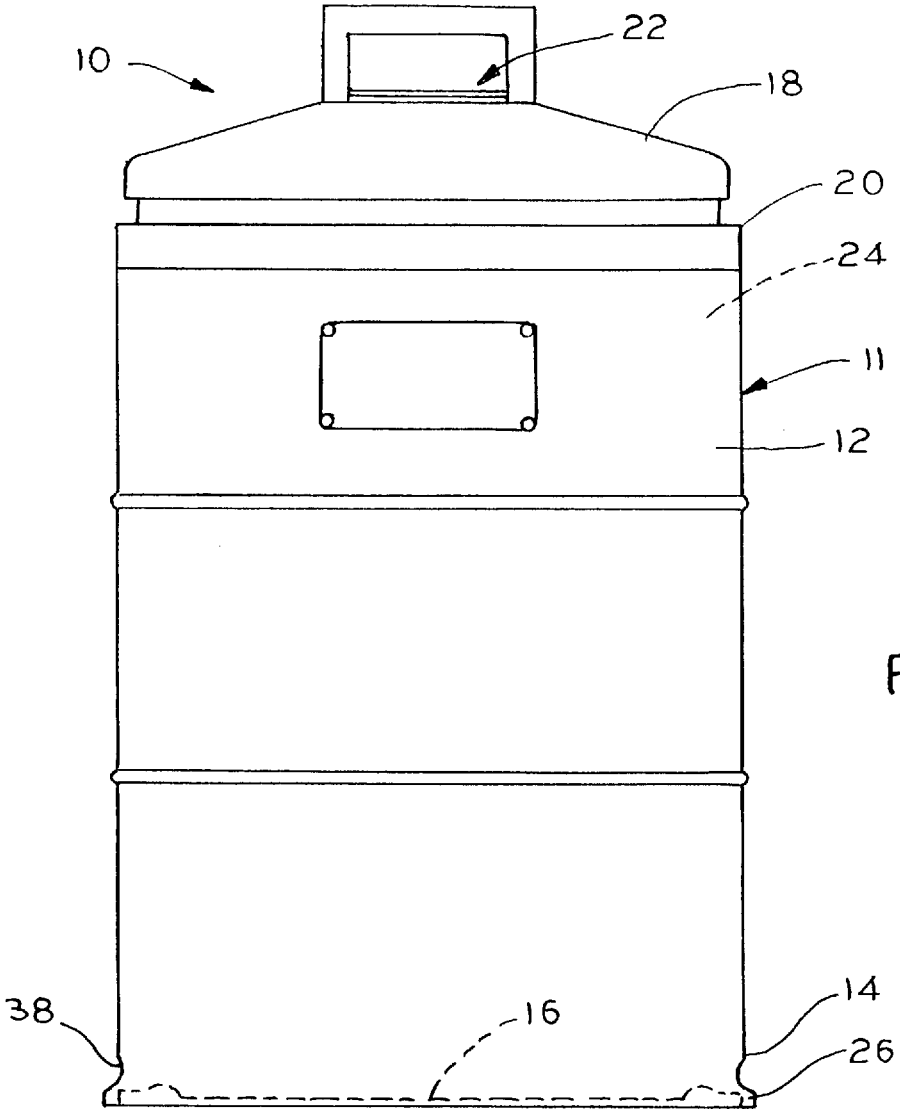
FIG. 1 is an elevation view of a plastic drum in accordance with the invention.

Referring to FIG. 1, a unitary plastic drum 10 in accordance with the invention is illustrated. The drum 10 is manufactured using a two step process. Initially, a drum body 11 is formed by blow molding using an HDPE resin such as plastic. Secondly a foot ring 26 is compression molded onto the drum body 11.

The drum body 11 includes a continuous outer wall defined by a generally cylindrical side wall 12 connected at a bottom end 14 to a bottom wall 16. A top wall 18 is connected at a top end 20 of the side wall 12. The top wall includes an opening 22 for accessing an interior space 24 of the drum 10. The side wall 12, the bottom wall 16 and the top wall 18 are formed using a conventional blow molding process to produce the drum body 11 having a wall thickness of approximately ⅛", minimum.

The drum 10 is approximately 35" in height and has a diameter of approximately 23". The interior space 24 is sized to hold approximately 55 gallon capacity. As is apparent, the drum body 11 could be formed of other sizes in accordance with the teachings of the invention.

Figure 2:
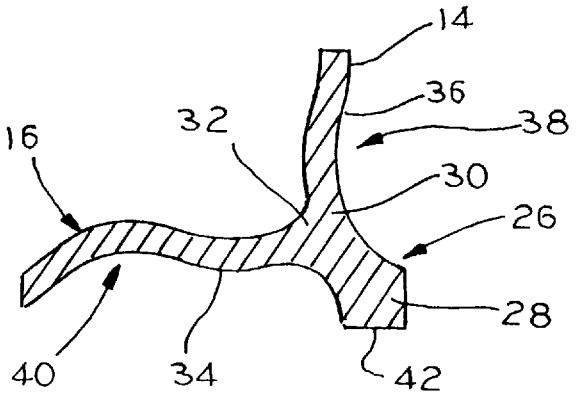
FIG. 2 is a detailed section of a foot ring of the drum of FIG. 1

The foot ring 26 is also formed of an HDPE resin. The foot ring 26 is connected to the bottom wall 16 and the side wall bottom end 14. Particularly, the foot ring is compression molded directly on to the blow molded drum body 11. The foot ring 26 is generally annular to surround a junction area 32 of the bottom wall 16 and the side wall bottom end 14. As illustrated in cross section in FIG. 2, the foot ring 26 includes a generally rectangular foot 28 connected via a neck 30 to the drum body junction area 32. The foot 28 in the illustrated embodiment of the invention is approximately 0.35" in height and 0.40" in depth. Thus, the foot 28 is approximately square in cross section. The neck 30 narrows diagonally upwardly from a top of the foot 28 and then widens where it joins the drum body junction area 32, as illustrated in phantom at a line 34.

The neck 30 is joined to the side wall bottom end 14 with an arcuate surface 36 to define a radially outwardly opening annular channel 38. The circular bottom wall 16 is generally planar having a downwardly opening arcuate channel 40 radially inwardly of the neck 30. In an empty state the foot 28 rests on a ground surface, or the like, with the bottom wall slightly elevated, as is particularly illustrated in FIG. 1, from a bottom surface 42 of the foot 28. Also, the foot 28 extends radially outwardly beyond the side wall 12. In fact, the entire foot 28 is located radially outwardly of the radially inward most point of the side wall channel 38 and downwardly of the bottom wall channel 40. Also, the foot 28 is substantially below and radially outwardly of the junction area 32.

The drum 10 weighs approximately 23 lbs. when empty. The use of the foot ring 26 for rolling the drum 10 provides a more solid feel than with prior drums. This is due to the unique design of the foot ring 26 including a thicker solid plastic construction. Additionally, the coefficient of friction is increased thus preventing the drum 10 from sliding on solid surfaces.

I claim:

1. An open top plastic drum comprising:

a cylindrical sidewall;

a circular, generally planar bottom wall connected at a bottom end of the side wall to define an interior storage space; and a foot ring connected proximate an intersection of the side wall and the bottom wall, the foot ring comprising an annular ring having, in cross section, a generally rectangular foot for engaging a ground surface, in use, and a neck diagonally connecting the foot to the bottom end of the side wall and the bottom wall, wherein the bottom wall is at an elevation above a bottom surface of the foot and the bottom wall has a downwardly opening annular channel radially inwardly of the neck.

2. The drum of claim 1 wherein said neck is connected to a top of the foot.

3. The drum of claim 1 wherein said neck narrows diagonally upwardly from the foot and the widens to connect to the bottom wall and the side wall.

4. The drum of claim 1 wherein the foot is generally square in cross section.

5. An open top plastic drum comprising:

a cylindrical side wall;

a circular bottom wall connected at a bottom end of the side wall to define an interior storage space; and a foot ring connected proximate an intersection of the side wall and the bottom wall, the foot ring comprising an annular ring having, in cross section, a generally rectangular foot for engaging a ground surface, in use, and a neck diagonally connecting the foot to the bottom end of the side wall and the bottom wall.

wherein said side wall has a radially outwardly opening groove upwardly of the neck.

6. The drum of claim 5 wherein said neck is connected to a top of the foot.

7. The drum of claim 5 wherein said neck narrows diagonally upwardly from the foot and then widens to connect to the bottom wall and the side wall.

8. The drum of claim 5 wherein the foot is generally square in cross section.

9. The drum of claim 5 wherein the bottom wall is generally planar and is at an elevation above a bottom surface of the foot.

10. An open top plastic drum comprising:

a cylindrical side wall;

a circular, generally planar bottom wall connected at a bottom end of the side wall to define an interior storage space; and a foot ring connected to a junction area of the side wall and bottom wall, the foot ring comprising an annular ring having a foot for engaging a ground surface, in use, and a neck connecting the foot to the junction area with the foot being substantially below and radially outwardly of the junction area, wherein the bottom wall is at an elevation above a bottom surface of the foot and the bottom wall has a downwardly opening annular channel radially inwardly of the neck.

11. The drum of claim 10 wherein said neck is connected to a top of the foot.

12. The drum of claim 10 wherein said neck narrows diagonally upwardly from the foot and the widens to connect to the junction area of bottom wall and the side wall.

13. The drum of claim 10 wherein the foot is generally square in cross section.

14. An open top plastic drum comprising:

a cylindrical side wall;

a circular bottom wall connected at a bottom end of the side wall to define an interior storage space; and a foot ring connected to a junction area of the side wall and the bottom wall, the foot ring comprising an annular ring having a foot for engaging a ground surface, in use, and a neck connecting the foot to the junction area with the foot being substantially below and radially outwardly of the junction area, wherein said side wall has a radially outwardly opening groove upwardly of the neck.

15. The drum of claim 14 wherein wherein said neck is connected to a top of the foot.

16. The drum of claim 14 wherein said neck narrows diagonally upwardly from the foot and then widens to connect to the junction area of the bottom wall and the side wall.

17. The drum of claim 14 wherein the foot is generally square in cross section.

18. The drum of claim 14 wherein the bottom wall is generally planar and is at an elevation above a bottom surface of the foot.

* * * * *